US007314240B1

(12) United States Patent
McPherson

(10) Patent No.: US 7,314,240 B1
(45) Date of Patent: Jan. 1, 2008

(54) PATIO BAR BRACKETS AND SECURITY ASSEMBLY

(76) Inventor: Gary M. McPherson, 138 Ranch Rd., Wrightstown, PA (US) 18940

( * ) Notice: Subject to any disclaimer, the term of this patent is extended or adjusted under 35 U.S.C. 154(b) by 0 days.

(21) Appl. No.: 11/668,672

(22) Filed: Jan. 30, 2007

(51) Int. Cl.
*E05C 19/18* (2006.01)

(52) U.S. Cl. ..... 292/259 R; 292/DIG. 46

(58) Field of Classification Search ..... 292/259 A, 292/259 R, 340, 341, DIG. 46; 248/535, 248/65, 264, 268
See application file for complete search history.

(56) References Cited

U.S. PATENT DOCUMENTS

| | | | | |
|---|---|---|---|---|
| 485,011 | A | 10/1892 | Kneeland | |
| 978,004 | A | 12/1910 | Burton | |
| 1,737,627 | A * | 12/1929 | Wear | 292/205 |
| 1,752,683 | A * | 4/1930 | Meagher | 248/251 |
| 2,702,205 | A | 2/1955 | Germain | |
| 3,304,034 | A * | 2/1967 | Jones | 242/598.4 |
| 3,328,920 | A | 7/1967 | Cohen et al. | |
| 3,698,754 | A | 10/1972 | Means | |
| 3,737,186 | A | 6/1973 | Chezem | |
| 3,805,322 | A | 4/1974 | Serrano | |
| 3,821,884 | A | 7/1974 | Walsh | |
| 3,955,841 | A | 5/1976 | Walker | |
| 4,190,985 | A | 3/1980 | Richards et al. | |
| 4,272,113 | A | 6/1981 | Zins | |
| 4,295,676 | A * | 10/1981 | Smith | 292/262 |
| 4,314,721 | A | 2/1982 | Clark | |
| 4,437,694 | A | 3/1984 | Lillo | |
| 4,438,594 | A | 3/1984 | Bunzl | |
| 4,461,502 | A | 7/1984 | Burgess | |
| 4,570,985 | A | 2/1986 | Waldo et al. | |
| 4,639,023 | A | 1/1987 | Boisvert | |
| 4,676,537 | A | 6/1987 | Esser | |
| 5,022,245 | A * | 6/1991 | Jordan et al. | 70/94 |
| 5,193,865 | A | 3/1993 | Allenbaugh | |
| 5,234,239 | A | 8/1993 | Allenbaugh | |
| 5,282,656 | A | 2/1994 | Fizer | |
| 6,382,689 | B1 | 5/2002 | Brown | |

* cited by examiner

*Primary Examiner*—Gary Estremsky
(74) *Attorney, Agent, or Firm*—Paul & Paul

(57) ABSTRACT

Security bar and brackets for a sliding patio door or sliding window, wherein the brackets are of mirrored structure and are intended to be mounted in a juxtaposed position for holding and releasing the security bar. A slot in each bracket guides the security bar into and out of the brackets. The movement of the security bar is in and downward when being inserted and upward and outward toward the operator when being removed. The path of movement dissuades jimmying, and aids in ease of bar removal by the operator.

10 Claims, 4 Drawing Sheets

PATIO BAR BRACKETS AND SECURITY ASSEMBLY

RELATED APPLICATIONS

The present applications is related to pending U.S. application no. 29/268,719 filed Nov. 8, 2006 for Security Bar Brackets design.

BACKGROUND OF THE INVENTION

The present invention is directed to security bar brackets for patio doors, basement windows, and sliding windows and the like.

Locks and security devices for sliding doors and window assemblies have taken many formats from locking pins, locking levers, door/window bars, and brackets.

Key plug locks, locking pins and locking levers have an obvious drawback in a panic or emergency situation such as with a hot fire or heavy smoke. These devices take concentration to operate and are not panic friendly.

Brackets and bars have become very popular because the strength of the locking function offered. These security bars and brackets have been offered in generally one of two types of confirmations. The first confirmation is a pair of upward-facing U-shaped type brackets, one mounted to each juxtaposed face of each door/window jamb to be inhibited from operating. The brackets are generally mounted in the middle of the door, i.e., at about mid-height. This confirmation presents two shortcomings. The first is that it is not "jimmy proof" from a jimmy tool inserted between the door/window seals and lifted upward. The second is that it requires the presence of mind by the occupant of the building, in a panic situation, to lift the bar upward to remove the bar and permit the door/window to be opened.

An alternate to the upward-facing U-brackets is to drop the security bar into the slider channel for the doors/windows. This provides a considerably more jimmy proof use, but creates a more dangerous lock in a panic situation, as the bar generally must be pried, by a flat object, out of the slider channel, in order to release the door/window to open. This is a much more dangerous situation in the presence of a fire, a gas leak emergency, or other panic situation.

The second confirmation offered has the bar secured to one door/window juxtaposed jamb, generally the middle, by a pinned pivot bracket. An upward-facing U-type bracket is mounted to the facing jamb to receive the free end of the security bar. The pinned pivot bracket end of the bar dissuades jimmying. However, the pinned pivot bracket presents an awkward release movement, especially in a panic situation.

What is desired is a security bar and brackets which hole the security bar in a relatively jimmy proof manner but which release the bar easily in a panic situation.

An objective of the present invention is to provide such desired security bar brackets to be easily mounted to juxtaposed patio door jambs or sliding window jambs in a proper orientation for optimum operation.

SUMMARY OF THE INVENTION

The objectives of the prevent invention are realized in a pair of brackets, of mirrored structure, which can be attached, one each, to juxtaposed sliding patio door or sliding window section jambs for holding a security bar there between, which held bar prevents said door or window from opening until removed by user from inside.

Security bar and brackets are fitted to the particular size of the sliding patio door or sliding window, wherein the brackets are mounted in a juxtaposed position on the face of the door or window section jamb, for holding and releasing the security bar.

A socket structure on each bracket holds the end of the security bar. Walls on each bracket define a slot in which the security bar ends move and guide the bar ends to the seated or removed positions.

Alignment surfaces make for ease of installation and concurrent alignment of the pair of brackets. Counter-sunk screw holes or other attachments are used in mounting each bracket to its respective jamb.

The slot in each bracket guides the security bar into and out of the brackets. The movement of the security bar is in-and-downward when being inserted and upward-and-outward toward the operator when being removed. The path of movement dissuades jimmying.

The brackets permit an "angled" or "arc-path" drop-in and pull-out operation of the security bar which presents a jimmy resistant structure, but one which is easily operable to release the security bar, in a panic situation.

BRIEF DESCRIPTION OF THE DRAWINGS

The features, advantage and operation of the present invention will become readily apparent and further understood from a reading of the following detailed description with the accompanying drawings, in which like numerals refer to like elements, and in which.

DETAILED DESCRIPTION OF THE INVENTION

Figure 1:
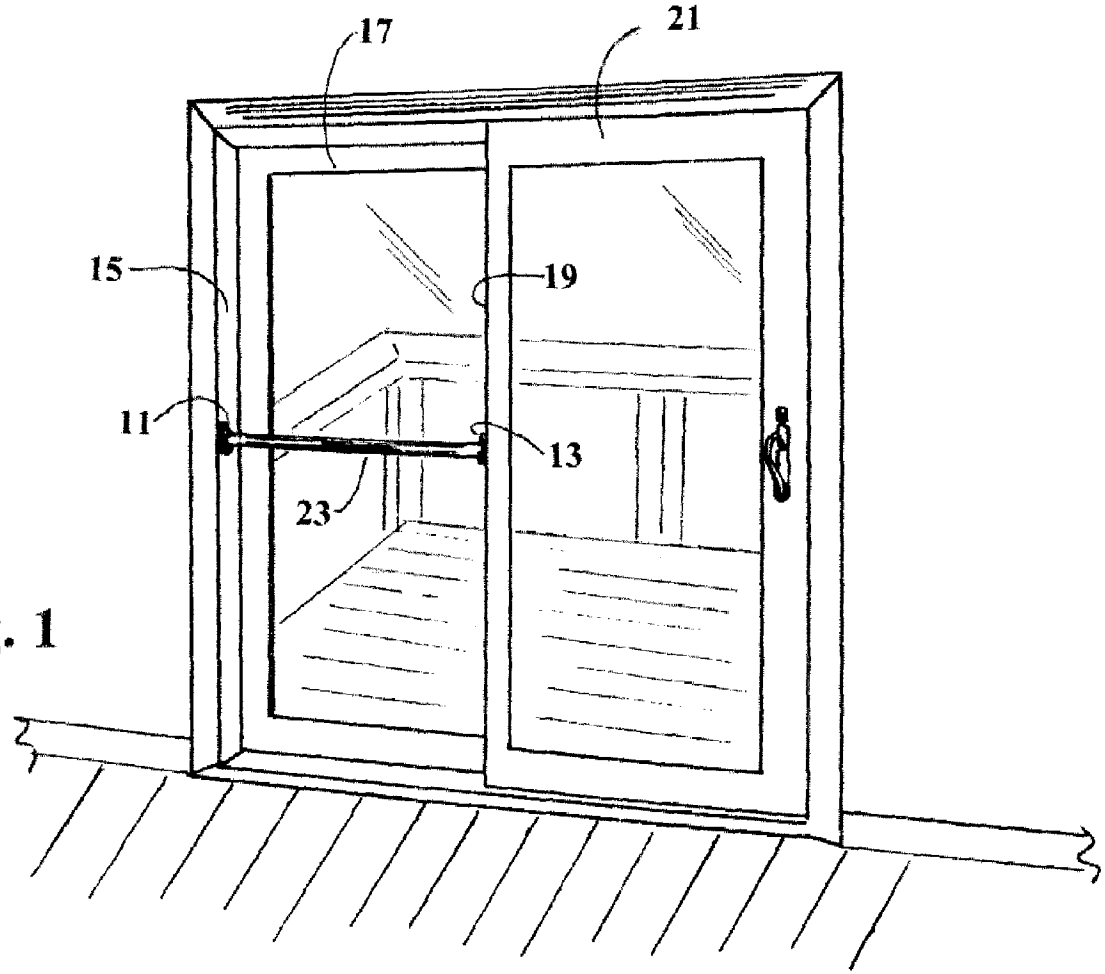
FIG. 1 is a partial perspective view of a sliding patio door with the brackets and security bar installed in the locked position.

The present invention is a security bar assembly for a sliding patio door and/or a sliding window. This security bar assembly includes a pair of brackets that are mountable, in juxtaposed position, on facing door or window section jambs. Usually the brackets 11, 13, FIG. 1, are mounted about mid-height on the wall jamb 15 of the non-sliding door section 17, and in inside jamb 19 of the sliding door section 21 of a patio door. A security bar 23 is held by the brackets 11, 13 and is positioned to be held between the brackets 11, 13 thereby inhibiting the opening of the patio door.

The brackets 11, 13 permit the installation of the security bar 23, by pushing it into the bracket openings and allowing it to drop down into the brackets 11, 13. Removal of the bar 23 is affected by pulling up and towards the operator. This is a natural motion in a panic situation.

Figure 2:
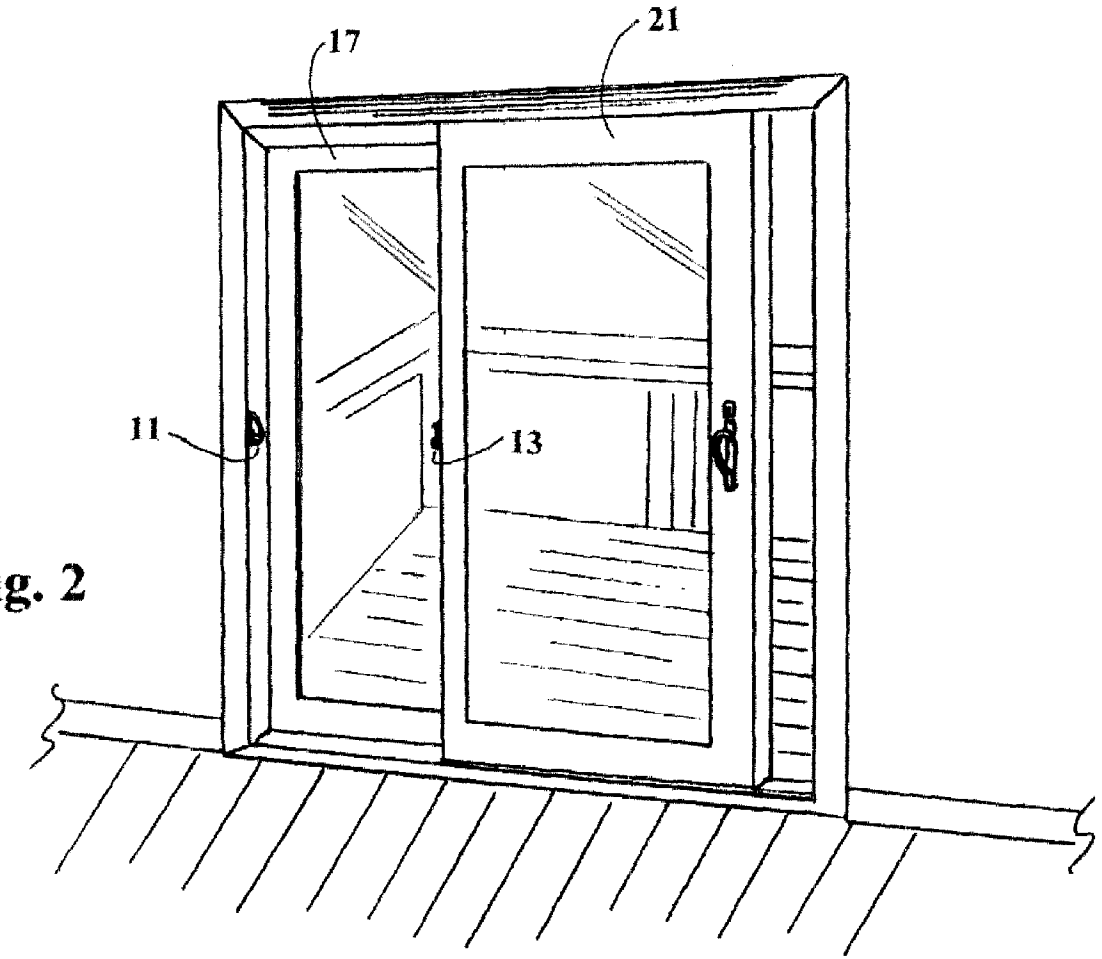
FIG. 2 is a partial perspective view of the sliding patio door with the security bar removed and the patio door sections released to open.
Figure 4:
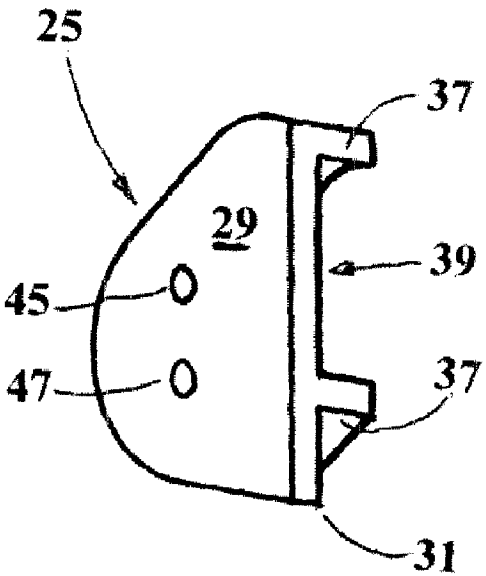
FIG. 4 is a perspective back view of the left-hand bracket of FIG. 3, the right-hand bracket being the mirror image thereof.
Figure 3:
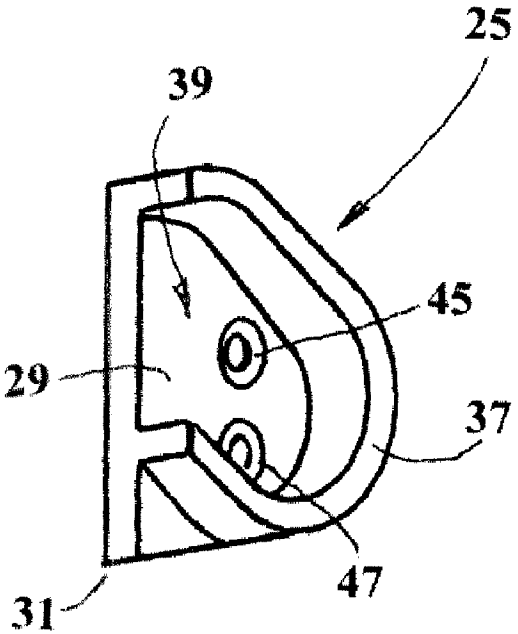
FIG. 3 is a perspective front view of the left-hand bracket when facing the patio door, the right-hand bracket being the mirror image thereof.
Figure 7:
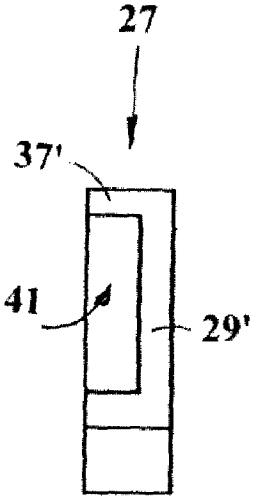
FIG. 7 is a side view of the right-hand bracket of FIG. 6 viewed as shown in FIG. 6.
Figure 6:
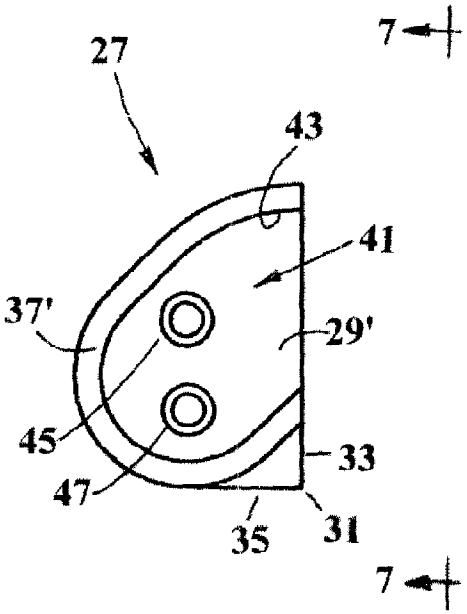
FIG. 6 is a face-on front view of the right-hand bracket.
Figure 5:
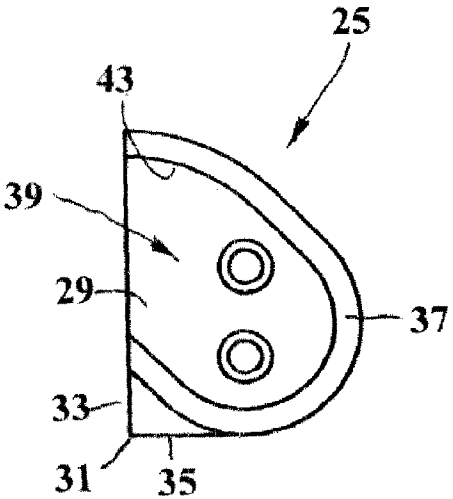
FIG. 5 is a face-on front view of the left-hand bracket of FIG. 3.

The security bar 23 can be of any cross-sectional shape. However, a round bar or post is convenient. The security bar 23 can be made of any material, from a metal pipe, to a wooden bar, post or dowel, to a plastic or fiberglass post. The size of the bar 23 and the size of the brackets 11, 13 are chosen to be compatible to the sliding patio door and/or sliding window application. The bar 23 can be cut to length. With the bar 23 manually removed, FIG. 2, the patio door is free to slide open.

The security bar 23 brackets 11, 13 are shown in detail in FIGS. 3-7. The left-hand bracket 23 and right-hand bracket 27 are mirror images of one another, FIGS. 5-6. Each bracket 11, 13 has a flat back wall 29, 29', respectively. Each back wall has a square bottom corner 31 which provides a true vertical edge 33 and horizontal edge 35, being perpendicular to each other, for aligning each bracket with the surface to which it is to be mounted. The remainder of each back wall 29, 29' terminates at the edge of an outward standing curved wall 37, 37' for each respective bracket 11, 13.

The curved walls 37, 37' each form a respective socket area 39, 41 on the respective brackets 11, 13. Each wall 37, 37' has a top portion, a rounded return portion and a bottom portion. The rounded return portion forms the bottom of a socket 39, 41 in which an end of the security bar 23 rests.

Each socket 39, 41 area provides an entrance opening wide enough to receive the bar 23 end. The top portion of a wall 37, 37' has a curved section 43 where the socket area 39, 41 curves downward. This concave curved section 43 and the remainder of the top portion of a wall 37, 37' forms a guide which controls the insertion and removal motions for a security bar 23.

When inserting a security bar 23, the ends thereof ride in each socket area 39, 41. As the bar 23 is inserted into each bracket with a horizontal motion, it is forced downward into the bottom of the socket area 39, 41 to rest on the rounded bottom portion.

When removing a security bar 23, it is pulled up and towards the operator and its travel motion within a bracket 11, 13 is guided by the walls 37, 37'.

If a burglar attempted to jimmy the security bar, he would have to lift the bar 23 which would then hang up on the top portion of the walls 37, 37' and specifically the curved portion 43. This would then require the burglar to move the bar 23 into the room, which is a motion not presently capable with known jimmy tools.

Each back wall 29, 29' has a pair of counter-sunk fastener holes 45, 47 for mounting the respective bracket to the inside of the sliding patio door sliding section and the edge of the door frame on the non-sliding section.

The insertion path of travel of a security bar into the brackets is first horizontally inward and then downward at about a 45 degree angle. The removal path of travel is upward at about a 45 degree angle and then outward horizontally.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

What is claimed is:

1. A pair of jimmy resistant brackets for holding a sliding patio door security bar in a horizontal position, said brackets being adapted for respective mounting on opposite juxtaposed vertical door members each bracket being a mirror image of the other, said door security bar being manually insertable into and removable from said brackets, comprising:

a door security bar;

a wall member adapted to seat against a said juxtaposed vertical door member; and a socket wall outward standing from said wall member, said outward standing socket wall defining a receiving slot in said bracket on the outward face of said wall member having an entrance opening and a bottom, said receiving slot being adapted for receiving and holding an end of a said patio door security bar;

wherein said socket wall has a rounded return portion defining the bottom of said slot and a concave curved section adjacent said entrance opening, said concave curved section acting as a camming surface for said bar insertion and removal motion.

2. The brackets of claim 1, wherein each said bracket includes a horizontal reference aid and a vertical reference aid adapted for assisting aligned mounting of a said bracket to a said vertical door member.

3. The brackets of claim 1, wherein said outward standing socket wall has a top portion, a bottom portion and wherein said rounded return portion connects said top and bottom portions, and wherein said rounded return portion is adapted to hold an end of said security bar.

4. The bracket of claim 3, wherein said top portion of said outward standing wall includes a concave curved section wherein the insertion of a security bar end into each bracket slot directs an arc-path push-in and drop-down motion.

5. The bracket of claim 4, wherein said slot has a first horizontal path section proximate said entrance opening and then a downward path section extending at about a 45 degree angle from said horizontal leading to said bottom, wherein said horizontal reference aid includes a horizontal wall edge on said back wall, and wherein said vertical reference aid includes a vertical wall edge on said back wall.

6. A patio bar security assembly comprising:

a straight security bar;

a first bracket adapted for mounting on a vertical door member, said first bracket having a mounting wall, and a socket wall outward standing from said mounting wall, said outward standing socket wall defining a receiving slot in said bracket on said mounting wall for receiving and holding an end of said straight security bar, said socket wall having a top portion, a rounded return portion and a bottom portion, wherein said rounded return portion forms the bottom of said slot where said security bar end is held wherein said slot has a first horizontal path section and then a downward path section extending at an angle from said horizontal wherein an arc-path drop-in and pull-out operation of said security bar is induced; and a second bracket being a mirror image of said first bracket, said second bracket being adapted for mounting on an opposite juxtaposed vertical door member from said first bracket vertical door member for receiving and holding an end of said straight security bar, said first and second brackets being adapted for juxtaposed positioning.

7. The assembly of claim 6, wherein said downward path section of said first and second bracket slots each extends downward at an angle from said horizontal, wherein said bracket slot walls include a concave curved section, and wherein said security bar is manually insertable into said brackets with first a horizontal motion away from a manual operator and then a downward motion, and wherein said security bar is manually removable with first an upward motion, and then a horizontal motion towards said manual operator.

8. A bracket for receiving and holding an end of a horizontally positioned security bar for a sliding patio door, comprising:

a flat wall member adapted to mounting on a vertical door jamb; and a socket on the outward face of said flat wall member for receiving and holding said end of said security bar;

wherein said socket includes a first and second socket wall portions upstanding from the outward face of said flat wall member, said first socket wall portion directing the movement of said security bar end into said socket in a horizontal direction and said second socket wall portion directing the further movement of said security bar end into said socket in a downward arc-ed direction extending away from said first wall portion.

9. The bracket of claim 8, wherein said second socket wall portion extends further in a downward angled direction, and wherein the transition between said first socket wall portion and said second wall portion includes a concave curved section.

10. The bracket of claim 9, wherein said further second socket wall portion downward angled direction is about 45 degrees, and wherein the first and second wall portions cooperate to reverse the direction of the movement of said security bar end for removal.

* * * * *